US007537686B2

(12) United States Patent
Varadaraj et al.

(10) Patent No.: US 7,537,686 B2
(45) Date of Patent: May 26, 2009

(54) INHIBITOR ENHANCED THERMAL UPGRADING OF HEAVY OILS

(75) Inventors: Ramesh Varadaraj, Flemington, NJ (US); Christopher P. Eppig, Vienna, VA (US); Douglas W. Hissong, Cypress, TX (US); Robert C. Welch, Baton Rouge, LA (US)

(73) Assignee: ExxonMobil Research and Engineering Company, Annadale, NJ (US)

( * ) Notice: Subject to any disclaimer, the term of this patent is extended or adjusted under 35 U.S.C. 154(b) by 390 days.

(21) Appl. No.: 11/127,731

(22) Filed: May 12, 2005

(65) Prior Publication Data

US 2006/0021907 A1 Feb. 2, 2006

Related U.S. Application Data

(60) Provisional application No. 60/571,308, filed on May 14, 2004.

(51) Int. Cl.

| | |
|---|---|
| ***C10L 1/00*** | (2006.01) |
| ***C10G 17/06*** | (2006.01) |
| ***C10G 35/06*** | (2006.01) |
| ***C10M 171/00*** | (2006.01) |
| ***C10C 3/00*** | (2006.01) |
| ***C10G 47/00*** | (2006.01) |

(52) U.S. Cl. ..... 208/107; 208/136; 208/224; 208/12; 208/22; 208/14

(58) Field of Classification Search ..... 208/14, 208/58, 108, 112, 12, 22, 107; 508/369
See application file for complete search history.

(56) References Cited

U.S. PATENT DOCUMENTS

| | | | | |
|---|---|---|---|---|
| 2,626,207 | A | 1/1953 | Wies et al. | |
| 3,558,474 | A | 1/1971 | Gleim et al. | 208/108 |
| 3,617,514 | A | 11/1971 | Marlar | 208/131 |
| 3,684,697 | A | 8/1972 | Gamson | 208/131 |
| 3,707,459 | A | 12/1972 | Mason et al. | 208/76 |
| 3,769,200 | A | 10/1973 | Folkins | 208/53 |
| 3,852,047 | A | 12/1974 | Schlinger et al. | 44/24 |
| 4,140,623 | A | 2/1979 | Sooter et al. | 208/131 |
| 4,226,805 | A | 10/1980 | Bauer | |
| 4,298,455 | A | 11/1981 | Huang | 208/48 AA |
| 4,399,024 | A | 8/1983 | Fukui et al. | 208/131 |
| 4,411,770 | A | 10/1983 | Chen et al. | 208/111 |
| 4,430,197 | A | 2/1984 | Poynor et al. | 208/56 |
| 4,440,625 | A | 4/1984 | Go et al. | 208/48 AA |
| 4,455,219 | A | 6/1984 | Janssen et al. | 208/131 |
| 4,478,729 | A * | 10/1984 | Hunt et al. | 508/329 |
| 4,518,487 | A | 5/1985 | Graf et al. | 208/131 |
| 4,529,501 | A | 7/1985 | George | 208/127 |
| 4,549,934 | A | 10/1985 | Graf et al. | 196/98 |
| 4,592,830 | A | 6/1986 | Howell et al. | 208/94 |
| 4,612,109 | A | 9/1986 | Dillon et al. | 208/131 |
| 4,616,308 | A | 10/1986 | Morshedi et al. | 364/159 |
| 4,619,756 | A | 10/1986 | Dickakian | |
| 4,659,453 | A | 4/1987 | Kukes et al. | 208/108 |
| 4,847,018 | A | 7/1989 | Koepke et al. | |
| 4,927,561 | A | 5/1990 | Forester | 252/389.22 |
| 4,966,679 | A * | 10/1990 | Kubo et al. | 208/58 |
| 5,160,602 | A | 11/1992 | Becraft et al. | 208/131 |
| 5,248,410 | A | 9/1993 | Clausen et al. | 208/131 |
| 5,258,115 | A | 11/1993 | Heck et al. | 208/131 |
| 5,296,130 | A * | 3/1994 | Kriz et al. | 208/107 |
| 5,460,714 | A * | 10/1995 | Fixari et al. | 208/112 |
| 5,645,711 | A | 7/1997 | Hraban et al. | 208/131 |
| 5,650,072 | A | 7/1997 | McClain et al. | |
| 5,820,750 | A * | 10/1998 | Blum et al. | 208/263 |
| 5,853,565 | A | 12/1998 | Cayton | 208/48 AA |
| 6,048,904 | A | 4/2000 | Wiehe et al. | 516/20 |
| 6,168,709 | B1 | 1/2001 | Etter | 208/131 |
| 6,193,875 | B1 | 2/2001 | Pereira et al. | 208/130 |
| 6,264,829 | B1 | 7/2001 | Antalffy et al. | 208/131 |
| 6,316,685 | B1 * | 11/2001 | Lauer et al. | 585/864 |
| 6,387,840 | B1 | 5/2002 | Salazar et al. | 502/170 |
| 6,611,735 | B1 | 8/2003 | Henly et al. | 700/266 |
| 6,660,131 | B2 | 12/2003 | Lah | 202/245 |
| 2002/0033265 | A1 | 3/2002 | Varadaraj | 166/303 |
| 2002/0125174 | A1 | 9/2002 | Varadaraj | 208/263 |
| 2002/0161059 | A1 | 10/2002 | Varadaraj et al. | 516/113 |

(Continued)

FOREIGN PATENT DOCUMENTS

| | | |
|---|---|---|
| EP | 0031697 | 7/1981 |

(Continued)

OTHER PUBLICATIONS

Kelley, J.J., "Applied artificial intelligence for delayed coking," Foster Wheeler USA Corp., Houston, TX, reprinted from Hydrocarbon Processing magazine, Nov. 2000, pp. 144-A-144-J.

(Continued)

*Primary Examiner*—Walter D Griffin
*Assistant Examiner*—Frank C Campanell
(74) *Attorney, Agent, or Firm*—Gerard J. Hughes; Bruce M Bordelon

(57) ABSTRACT

A method for upgrading heavy oils by contacting the heavy oil with an inhibitor additive and then thermally treating the inhibitor additized heavy oil. The invention also relates to the upgraded product from the inhibitor enhanced thermal treatment process.

18 Claims, 1 Drawing Sheet

U.S. PATENT DOCUMENTS

| | | | | |
|---|---|---|---|---|
| 2003/0127314 | A1 | 7/2003 | Bell et al. | 202/262 |
| 2003/0132139 | A1 | 7/2003 | Varadaraj | 208/265 |
| 2003/0191194 | A1 | 10/2003 | Varadaraj | 516/52 |
| 2004/0035749 | A1 | 2/2004 | Khan et al. | 208/106 |

FOREIGN PATENT DOCUMENTS

| | | | |
|---|---|---|---|
| EP | 175511 | | 6/1988 |
| EP | 0839782 | A1 | 5/1998 |
| GB | 1218117 | | 6/1971 |
| WO | 95/14069 | | 5/1995 |
| WO | 99/64540 | | 12/1999 |
| WO | 03042330 | | 5/2003 |
| WO | 03048271 | | 12/2003 |
| WO | 2004/104139 | | 2/2004 |
| WO | 2004/038316 | | 6/2004 |

OTHER PUBLICATIONS

Gentzis, Thomas; Rahimi, Pavis; Malhotra, Ripudaman; Hirschon, Albert S., "The effect of carbon additives on the mesophase induction period of Athabasca bitumen," Fuel Processing Technology 69 (2001) pp. 191-203.

Dabkowski, M.J.; Shih, S.S.; Albinson, K.R., "Upgrading of petroleum residue with dispersed additives," Mobil Research & Developmental Corporation, Paulsboro, NJ. Presented as Paper 19E at the 1990 AlChE National Meeting.

Giavarini, C.; Mastrofini, D.; Scarsella, M., "Macrostructure and Rheological Properties of Chemically Modified Residues and Bitumens," Energy & Fuels 2000, 14, pp. 495-502.

Lakatos-Szabo, J.; Lakatos, I., "Effect of sodium hydroxide on interfacial rheological properties of oil-water systems," Research Institute of Applied Chemistry, University of Miskolc, Hungary, accept Aug. 24, 1998, Elsevier Science B.V., Physicochemical and Engineering Aspects 149 (1999) pp. 507-513.

Ellis, Paul J.; Paul, Christopher A., "Tutorial: Delayed Coking Fundamentals," Great Lakes Carbon Corporation, Port Arthur, TX, copyright 1998 (unpublished). Presented at the AlChE 1998 Spring National Meeting, New Orleans, LA, Mar. 8-12, 1998.

* cited by examiner

FIGURE
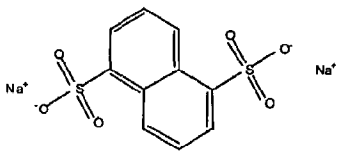
naphthalene 1,5- disulfonic acid sodium salt
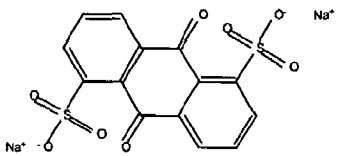
anthraquinone-1,5-disulfonic acid disodium salt
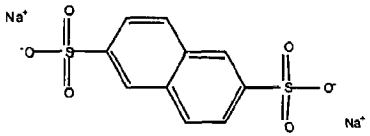
naphthalene 2,6- disulfonic acid sodium salt
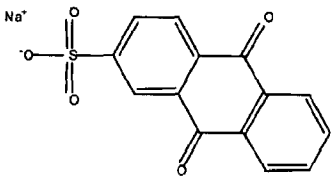
anthraquinone 2-sulfonic acid sodium salt
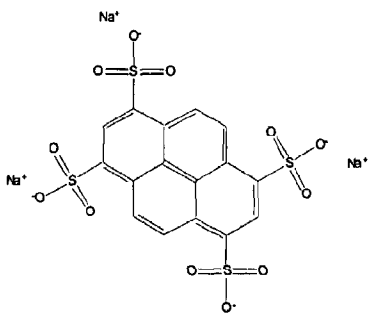
pyrene 1,3,6,8-tetra sulfonic acid sodium salt
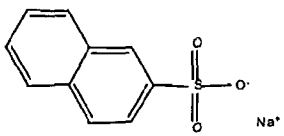
naphthalene 2- sulfonic acid sodium salt
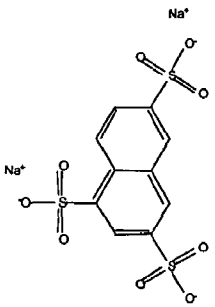
naphthalene 1,3,6- trisulfonic acid sodium salt

INHIBITOR ENHANCED THERMAL UPGRADING OF HEAVY OILS

CROSS-REFERENCE TO RELATED APPLICATION

This application claims benefit of U.S. Provisional Application Ser. No. 60/571,308 filed May 14, 2004.

FIELD OF THE INVENTION

The present invention relates to a method for upgrading heavy oils by contacting the heavy oil with an inhibitor additive and then thermally treating the inhibitor additized heavy oil. The invention also relates to the upgraded product from the inhibitor enhanced thermal treatment process.

BACKGROUND OF THE INVENTION

Heavy oils are generally referred to those hydrocarbon comprising oils with high viscosity or API gravity less than about 20. Crude oils and crude oil residuum obtained after atmospheric or vacuum distillation of crude oils that exhibit an API gravity less than about 20 are examples of heavy oils. Upgrading of heavy oils is important in production, transportation and refining operations. An upgraded heavy oil typically will have a higher API gravity and lower viscosity compared to the heavy oil that is not subjected to upgrading. Lower viscosity will enable easier transportation of the oil. A commonly practiced method for heavy oil upgrading is thermal treatment of heavy oil. Thermal treatment includes processes such as visbreaking and hydro-visbreaking (visbreaking with hydrogen addition). The prior art in the area of thermal treatment or additive enhanced visbreaking of hydrocarbons teach methods for improving the quality, or reducing the viscosity, of crude oils, crude oil distillates or residuum by several different methods. For example, the use of additives such as the use of free radical initiators is taught in U.S. Pat. No. 4,298,455; the use of thiol compounds and aromatic hydrogen donors is taught in EP 175511; the use of free radical acceptors is taught in U.S. Pat. No. 3,707,459; and the use of a hydrogen donor solvent is taught in U.S. Pat. No. 4,592,830. Other art teaches the use of specific catalysts, such as low acidity zeolite catalysts (U.S. Pat. No. 4,411,770) and molybdenum catalysts, ammonium sulfide and water (U.S. Pat. No. 4,659,543). Other references teach upgrading of petroleum resids and heavy oils (Murray R. Gray, Marcel Dekker, 1994, pp. 239-243) and thermal decomposition of naphthenic acids (U.S. Pat. No. 5,820,750).

Generally, the process of thermal treatment of heavy oil can result in an upgraded oil with higher API. In some instances, the sulfur and naphthenic acid content can also be reduced. However, the main drawback of thermal treatment of heavy oils is that with increased conversion there is the formation of toluene insoluble (TI) material. These toluene insoluble materials comprise organic and organo-metallic materials derived from certain components of the heavy oil during the thermal process. Generally, the TI materials tend to increase exponentially after a threshold conversion. Thus, the formation of TI materials limits the effectiveness of thermal upgrading of heavy oils. Presence of TI material in upgrading oils is undesirable because such TI materials can cause fouling of storage, transportation and processing equipment. In addition, the TI materials can also induce incompatibility when blended with other crude oils. Increasing conversion without generating toluene insoluble material is a long-standing need in the area of thermal upgrading of heavy oils. The instant invention addresses this need. As used herein, crude oil residuum or resid refers to residual crude oil obtained from atmospheric or vacuum distillation of a crude oil.

SUMMARY OF THE INVENTION

In one embodiment, there is provided a method for upgrading a heavy oil comprising the steps of:

- contacting the heavy oil with an effective amount of an inhibitor additive to provide an inhibitor additized heavy oil, and then
- thermally treating said inhibitor additized heavy oil at a temperature in the range of about 250° C. to 500° C. for 0.5 to 6 hours to upgrade the heavy oil.

Another embodiment is an upgraded heavy oil prepared by:

- contacting the heavy oil with an effective amount of an inhibitor additive to provide an inhibitor additized heavy oil, and then
- thermally treating said inhibitor additized heavy oil at a temperature in the range of about 250° C. to 500° C. for 0.5 to 6 hours.

Yet another embodiment is a method for upgrading a heavy oil comprising the steps of:

- contacting the heavy oil with an effective amount of a bifunctional inhibitor additive to provide a bifunctional inhibitor additized heavy oil, and then
- thermally treating said inhibitor additized heavy oil at a temperature in the range of about 250° C. to 500° C. in the presence of hydrogen at hydrogen partial pressure of between 500 to 2500 psig for a time between 0.1 to 10 hours to upgrade the heavy oil.

Another embodiment is an upgraded heavy oil prepared by:

- contacting the crude oil with an effective amount of a bifunctional additive to provide a bifunctional additized heavy oil, and then
- thermally treating said additized heavy oil at a temperature in the range of about 250° C. to 500° C. in the presence of hydrogen at hydrogen partial pressure of between 500 to 2500 psig for a time between 0.1 and 10 hours.

Still another embodiment is a bifunctional inhibitor-hydrotreating additive having the chemical structure:

$$[\text{R-PNA-}(SO_3^-)_n]_a M_b$$

wherein PNA is a polynuclear aromatic hydrocarbon containing 2 to 15 aromatic rings; n is an integer from 1 to 15 representing the number of sulfonic $SO_3^-$ functionality on the PNA hydrocarbon; R is an alkyl group containing from 0 to 40 carbon atoms; M is an element selected from the group consisting of Group IV-B, V-B, VI-B, VII-B and VIII of the Long Form of The Periodic Table of Elements; and a and b are integers each ranging from 1 to 4.

BRIEF DESCRIPTION OF THE FIGURE

The FIGURE hereof shows illustrative examples of R-PNA-$(X)_n$ inhibitor additives of the instant invention wherein R═O, X═$SO_3^-$ and the additives are sodium salts of the PNA-sulfonic acids.

DETAILED DESCRIPTION OF THE INVENTION

According to one embodiment of the invention, there is provided a method for upgrading heavy oils, such as heavy oils and crude oil residuum. Resid feedstocks include but are not limited to residues from the atmospheric and vacuum distillation of petroleum crudes or the atmospheric or vacuum distillation of heavy oils, visbroken resids, tars from deasphalting units or combinations of these materials. Atmospheric and vacuum topped heavy bitumens can also be employed. Typically, such feedstocks are high-boiling hydrocarbonaceous materials having a nominal initial boiling point of about 538° C. or higher, an API gravity of about 20° or less, and a Conradson Carbon Residue content of about 0 to 40 weight percent.

An inhibitor additive is added to the crude or crude oil residuum followed by thermal treatment at temperatures in the range of about 250° C. to 500° C. for about 30 second to 6 hours.

The inhibitor additive is a polynuclear aromatic acid of the structures:

$$\text{R-PNA-(X)}_n$$

wherein PNA is a polynuclear aromatic hydrocarbon containing 2 to 15 aromatic rings and X is an acid functionality selected from the group consisting of $SO_3H$, COOH, and $PO_3H$ and n is an integer from 1 to 15 representing the number of acid functionality (X) on the PNA structure. The aromatic rings can be fused or isolated aromatic rings. Further, the aromatic ring can be homo-nuclear or hetero-nuclear aromatic rings. By homo-nuclear aromatic ring is meant aromatic rings containing only carbon and hydrogen. By hetero-nuclear aromatic ring is meant aromatic rings that contain nitrogen, oxygen or sulfur in addition to carbon and hydrogen. R is an alkyl group containing from 0 to 40 carbon atoms. R can be a linear or branched alkyl group. Mixtures of R-PNA-$(X)_n$ can be used. R-PNA-sulfonic acids are preferred. Salts of the R-PNA-$(X)_n$ additives are more preferred. Group I or Group II elements of the Long Form of The Periodic Table of Elements such as sodium, potassium or calcium are the most preferred. Some illustrative non-limiting examples of preferred R-PNA-$(X)_n$ inhibitor additives are given in the sole FIGURE hereof.

Typically, the amount of inhibitor additive added can be about 10 to about 50,000 wppm, preferably about 20 to 3000 wppm, and more preferably 20 to 1000 wppm based on the amount of crude oil or crude oil residuum. The inhibitor additive can be added as is or in a suitable carrier solvent. Preferred carrier solvents are aromatic hydrocarbon solvents such as toluene, xylene, crude oil derived aromatic distillates such as Aromatic 150 sold by ExxonMobil Chemical Company, water, alcohols and mixtures thereof. When the inhibitor additive is a salt of the PNA-acid it is preferred to use water or water-alcohol mixtures as the carrier solvent. Preferred alcohols are methanol, ethanol, propanol and mixtures thereof. When mixtures of PNA-acid and PNA-acid salts are used, it is preferred to use an emulsion of water and hydrocarbon solvents as the carrier medium. The emulsion can be a water-in-oil emulsion or an oil-in-water emulsion. The carrier solvent is preferably 10 to 80 weight percent of the mixture of additive and carrier solvent.

Contacting the inhibitor additive with the heavy oil can be achieved at any time prior to the thermal treatment. Contacting can occur at the point where the heavy oil is produced at the reservoir, during transportation or at a refinery location. In the case of crude oil resids, the inhibitor additive is contacted at any time prior to thermal treatment. After contacting, it is preferred to mix the heavy oil and additive. Any suitable mixing means conventionally known in the art can be used. Non-limiting examples of such suitable mixers include in-line static mixers and paddle mixers. The contacting of the heavy oil and additive can be conducted at any temperature in the range of 10° C. to 90° C. After contacting and mixing the heavy oil and additive, the mixture can be cooled from about contacting temperature to about ambient temperature, i.e., about 15° C. to 30° C. Further, the additized-cooled mixture can be stored or transported from one location to another location prior to thermal treatment. Alternately, the additized and cooled mixture can be thermally treated at the location of contacting if so desired.

Thermal treatment of the additized heavy oil comprises heating the oil at temperatures in the range of about 250° C. to 500° C. for about 30 seconds to 6 hours. Process equipment such as visbreakers can be advantageously employed to conduct the thermal treatment It is preferred to mix the additized heavy oil during thermal treatment using mixing means known to those having ordinary skill in the art. It is also preferred to conduct the thermal treatment process in an inert environment. Using inert gases such as nitrogen or argon gas in the reactor vessel can provide such an inert environment.

The inhibitor enhanced thermal upgrading process provides a thermally upgraded product that is higher in API gravity compared to the starting feed and lower in toluene insoluble material compared to a thermally upgraded product that is produced in the absence of the inhibitor additive of the instant invention. The inhibitor additive of the instant invention inhibits the formation of toluene insoluble material while facilitating thermal conversion, such as thermal cracking, to occur in a facile manner. The thermally upgraded product of the process of the instant invention has at least 20% less toluene insoluble material compared to the product from a thermally upgraded process conducted at the same temperature for the same period of time, but in the absence of the inhibitor additive. The thermally upgraded product of the process of the instant invention has at least 15 API units higher compared to the product from a thermally upgraded process conducted at the same temperature for the same period of time, but in the absence of the inhibitor additive. The upgraded oil of the instant invention comprises the upgraded heavy oil, the added inhibitor additive and products, if any, formed from the added inhibitor additive during the thermal upgrading process.

When the upgrading is conducted in a pre-refinery location, it is customary to mix the upgraded oil with other produced but not thermally treated crude oils prior to transportation and sale. The other produced but not thermally treated crude oils, can be the same heavy oil from which the upgraded oil is obtained or different crude oils. The other produced but not thermally treated crude oils can be dewatered and or desalted crude oils. By "non-thermally treated" is generally meant not thermally treated at temperatures in the range of about 250° C. to 500° C. for about 30 seconds to 6 hours. A particular advantage of the upgraded oil of the instant invention is that the presence of a relatively low amount of toluene insoluble (TI) material enables blending of the upgraded oil and other oils in a compatible manner. The mixture of upgraded oil of the instant invention with other compatible oils is a novel and valuable product of commerce. Another feature of the upgraded oil product of the instant invention is that the product can also be mixed with distillates or resids of other crude oils in a compatible manner. The low TI levels in the product enables this mixing or blending.

Thermal Upgrading with Hydrogen and Bifunctional Additive

According to another embodiment of the invention, there is provided a thermal treatment method for upgrading heavy crude oils and crude oil residuum including hydrogen. A bifunctional additive that provides the dual functionality of TI inhibition and catalysis of hydrogenation reactions is added to the crude or crude oil residuum followed by thermal treatment. The thermal treatment comprises treating the bifunctional additized oil at a temperature in the range of about 250° C. to 500° C. in the presence of hydrogen at hydrogen partial pressures of between 500 to 2500 psig for a time between 0.1 to 10 hours to result in an upgraded oil.

Examples of bifunctional additives suitable for thermal treatment method, including hydrogen for upgrading of heavy oils, are polynuclear aromatic sulfonic acid and alkyl polynuclear aromatic sulfonic acid salts of the metals of Group IV-B, V-B, VI-B, VII-B and VIII of the Periodic Table of Elements. The bifunctional additive is represented by the chemical structure:

$$[\text{R-PNA-}(X)_n]_a M_b$$

wherein PNA is a polynuclear aromatic hydrocarbon containing 2 to 15 aromatic rings; X is a sulfonic acid functionality, n is an integer from 1 to 15 representing the number of sulfonic acid functionality on the PNA hydrocarbon; R is an alkyl group containing from 0 to 40 carbon atoms; M is an element selected from the group consisting of Group IV-B, V-B, VI-B, VII-B and VIII of the Long Form of The Periodic Table of Elements; and a and b are integers each ranging from 1 to 4. The R group can be a linear or branched alkyl group. The aromatic rings can be fused or isolated aromatic rings. Further, the aromatic rings can be homo-nuclear or hetero-nuclear aromatic rings. By homo-nuclear aromatic rings is meant aromatic rings containing only carbon and hydrogen. By hetero-nuclear aromatic ring is meant aromatic rings that contain nitrogen, oxygen and sulfur in addition to carbon and hydrogen.

When the metal component of the bifunctional additive is a Group IV-B metal it may be titanium (Ti), zirconium (Zr), or hafnium (Hf). When the metal is a Group V-B metal it may be vanadium (V), niobium (Nb), or tantalum (Ta). When the metal is a Group VI-B metal it may be chromium (Cr), molybdenum (Mo), or tungsten (W). When the metal is a Group VII-B metal it can be manganese (Mn) or rhenium (Re). When the metal is a Group VIII metal it may be a non-noble metal such as iron (Fe), cobalt (Co), or nickel (ni) or a noble metal such as ruthenium (Ru), rhodium (Rh), palladium (Pd), osmium (Os), iridium (Ir), or platinum (Pt). Preferably, the metal is a Group VI-B metal, most preferably molybdenum.

An effective amount of the bifunctional additive may be oil-miscible or oil-dispersible. It is preferred that the bifunctional additives of the instant invention, by virtue of their molecular structure, exhibit favorable compatibility with asphaltene-rich heavy oils. The bifunctional additives may also be activated under the conditions of the hydroconversion process.

The impact of the bifunctional additive may be augmented by use of mixtures of bifunctional additives of more than one metal. For example, if molybdenum is used, it is desirable to add an additional quantity of cobalt. This is anticipated to yield a positive synergistic effect on catalytic hydrogenation process. Typically, cobalt may be added in an amount from about 0.2 to about 2 mols, preferably about 0.4 mols per mol of molybdenum.

The bifunctional additive can be present in an amount ranging from 1 to 300 wppm metal. More preferably in the range of about 1 to about 60 wppm of metal based on hydrocarbon oil to be hydroconverted. It is preferred to mix the heavy oil and additive during the thermal treatment upgrading process. Mixing means and process equipment known to one having ordinary skill in the art can be used. Process equipment operable at high pressure, such as high pressure visbreakers, can be advantageously used to conduct the thermal treatment process in the presence of hydrogen.

The bifunctional additive can be contacted with the heavy oil as is or with use of a carrier solvent. Preferred carrier solvents include aromatic hydrocarbon solvents such as toluene, xylene, crude oil derived aromatic distillates such as Aromatic 150 sold by ExxonMobil Chemical Company, water, alcohols and mixtures thereof. Preferred alcohols are methanol, ethanol, propanol and mixtures thereof. The carrier solvent can range from 10 to 80 weight percent of bifunctional additive and carrier solvent.

Contacting the heavy oil with the bifunctional additive can be achieved at any time prior to thermal treatment. Contacting can occur at the point where the heavy oil is produced at the reservoir, during transportation, or at a refinery location. In the case of crude oil resids, the bifunctional additive is contacted at any time prior to the thermal treatment. After contacting, it is preferred to mix the heavy oil and additive. Any suitable mixing means conventionally known in the art can be used. Non-limiting examples of such suitable mixers include in-line static mixers and paddle mixers. The contacting of the heavy oil and additive can be conducted at any temperature in the range of about 10° C. to 90° C. for an effective amount of time. After contacting and mixing the mixture of heavy oil and additive the mixture can be cooled from about contacting temperature to about ambient temperature, i.e., about 15° C. to about 30° C. Further, the additized-cooled mixture can be stored or transported from one location to another location prior to thermal treatment. Alternately, the additized and cooled mixture can be thermally treated at the location of contacting if so desired. Thermal treatment of the bifunctional additized heavy oil comprises heating said additized heavy oil at a temperature in the range of about 250° C. to about 500° C. in the presence of hydrogen at hydrogen partial pressure of between about 500 to about 2500 psig, for a time between about 0.1 to about 10 hours to result in an upgraded oil product.

The bifunctional additive enhanced hydrotreating upgrading process of the present invention provides an upgraded product that is higher in API gravity compared to the starting feed and lower in toluene insoluble material compared to a hydrotreated upgraded product that is produced in the absence of the bifunctional additive of the instant invention. By virtue of the inhibitor function of the bifunctional additive, the formation of toluene insoluble material is inhibited while facilitating hydroconversion to occur in a facile manner. The upgraded product of the thermal treatment process in the presence of hydrogen has at least 20% less toluene insoluble material compared to the product from a thermal treatment process conducted at the same temperature for the same period of time but in the absence of the bifunctional inhibitor-hydrotreating additive. The upgraded oil of the instant invention comprises the upgraded heavy oil, the added bifunctional additive and products formed from the added bifunctional additive during the thermal upgrading process.

EXAMPLE

The following examples are included herein for illustrative purposes and are not meant to be limiting.

Synthesis of Bifunctional Inhibitor-Hydrotreating Additives

As an illustration, two synthetic routes for a molybdenum containing bifunctional additive are described. The bifunctional molybdenum additive can be synthesized by the method disclosed in GB 1215120A, which is incorporated herein by reference. A reaction mixture is prepared by admixing molybdenyl bis-acetylacetonate and the PNA-sulfonic acid which, in accordance with the stoichiometry of the reaction for forming a molybdenum mono-sulfonic compound, theoretically requires the use of one mol of sulfonic acid for each mol of molybdenyl bis-acetonate present. Preferably, the mol ratio of PNA-sulfonic acid to the molybdenyl bis-acetylacetonate is from 5:1 up to 10:1, providing an excess of PNA-sulfonic acid over that required and further enhancing the formation of molybdenum PNA-sulfonate compound. Lower ratios of PNA-sulfonic acid to the molybdenyl bis-acetylacetonate can be used which may range from as low as one mol up to 5 mols of PNA-sulfonic acid per mol of molybdenum bis-acetylacetonate. It is ordinarily necessary when using such lower ratios to effect a thinning of the viscous reaction mixture with an inert organic solvent, such as a mineral oil. The reaction medium is slowly heated from room temperature to a temperature of about 190° C., and thereafter held at a temperature of about 190° C. to about 210° C. for a period of time sufficient to effect removal of acetylacetone, followed by a cooling of the reaction mixture.

In an alternate method of synthesis, molybdenum trioxide and the corresponding PNA-sulfonic acid are mixed in the required stoichiometric ratio in an inert high boiling solvent and heated to temperatures in the range of 150° C. to 200° C. to provide the molybdenum salt of the PNA-sulfonic acid salt as a colloidal suspension in the inert solvent.

The invention claimed is:

1. A method for upgrading a heavy oil comprising the steps of:

a) contacting the heavy oil with an effective amount of an inhibitor additive to provide an inhibitor additized heavy oil, which inhibitor additive is represented by the chemical structure:

$$R\text{-}PNA\text{-}(X)_n$$

wherein R is an alkyl group containing from 0 to 40 carbon atoms; PNA is a polynuclear aromatic hydrocarbon containing 2 to 15 aromatic rings; X is an acid functionality selected from the group consisting of $SO_3H$, COOH, and $PO_3H$; and n is an integer from 1 to 15; and b) thermally treating said inhibitor additized heavy oil at a temperature in the range of about 250° C. to 500° C. in the presence of hydrogen at hydrogen partial pressure of between 500 to 2500 psig for a time between 0.1 to 10 hours.

2. The method of claim 1 wherein the amount of inhibitor additive used is from about 10 to about 50,000 ppm based on the weight of the heavy oil.

3. The method of claim 1 which is conducted in an inert environment.

4. The method of claim 1 wherein said contacting is conducted at a temperature from about 25° C. to about 90° C. for a time ranging from about 1 minute to about 24 hours.

5. The method of claim 1 wherein the heavy oil is selected from the group consisting of crude oil, vacuum resids and atmospheric resids.

6. The method of claim 1 which further comprises the step of first providing the inhibitor additive with a carrier solvent and then contacting the heavy oil with a mixture of inhibitor additive and carrier solvent.

7. The method of claim 6 wherein the carrier solvent is selected from the group consisting of water, aromatic hydrocarbon, alcohols and mixtures thereof.

8. The method of claim 6 wherein the carrier solvent is from about to 10 to 80 wt. % of the mixture of inhibitor additive and carrier solvent.

9. A method for upgrading a heavy oil comprising the steps of:

a) contacting the heavy oil with an effective amount of an inhibitor additive to provide an inhibitor additized heavy oil, which inhibitor additive is represented by the chemical structure:

$$[R\text{-}PNA\text{-}(SO_3)_n]_aM_b$$

wherein PNA is a polynuclear aromatic hydrocarbon containing 2 to 15 aromatic rings; n is an integer from 1 to 15; R is an alkyl group containing from 0 to 40 carbon atoms; M is an element selected from the group consisting of Group IV-B, V-B, VI-B, VII-B and VIII of the Long Form of The Periodic Table of Elements; and a and b are integers each ranging from 1 to 4; and b) thermally treating said inhibitor additized heavy oil at a temperature in the range of about 250° C. to 500° C. in the presence of hydrogen at hydrogen partial pressure of between 500 to 2500 psig for a time between 0.1 to 10 hours.

10. The method of claim 9 wherein the amount of inhibitor additive used is from about 10 to about 50,000 ppm based on the weight of the heavy oil.

11. The method of claim 9 which is conducted in an inert environment.

12. The method of claim 9 wherein said contacting is conducted at a temperature from about 25° C. to about 90° C. for a time ranging from about 1 minute to about 24 hours.

13. The method of claim 9 wherein the heavy oil is selected from the group consisting of crude oil, vacuum resids and atmospheric resids.

14. The method of claim 1 which further comprises the step of first providing the inhibitor additive with a carrier solvent and then contacting the heavy oil with a mixture of inhibitor additive and carrier solvent.

15. The method of claim 14 wherein the carrier solvent is selected from the group consisting of water, aromatic hydrocarbon, alcohols and mixtures thereof.

16. The method of claim 14 wherein the carrier solvent is from about 10 to 80 wt. % of the mixture of inhibitor additive and carrier solvent.

17. The method of claim 14 wherein M is selected from Groups VIII and VI-B.

18. The method of claim 17 wherein M is Mo.

* * * * *